United States Patent [19]

Jude

[11] Patent Number: 5,024,447

[45] Date of Patent: Jun. 18, 1991

[54] TRANSMITTER IN ARROW

[76] Inventor: Arthur D. Jude, 7821 E. Dublin, Granville, Ohio 43054

[21] Appl. No.: 405,761

[22] Filed: Sep. 11, 1989

Related U.S. Application Data

[63] Continuation-in-part of Ser. No. 822,779, Jun. 9, 1986, abandoned.

[51] Int. Cl.[5] ..... F42B 6/04

[52] U.S. Cl. ..... 273/416; 342/386; 343/827; 343/897

[58] Field of Search ..... 273/416, 418–422; 342/386; 343/893, 897, 725, 825–827, 900–903, 720

[56] References Cited

U.S. PATENT DOCUMENTS

| | | | |
|---|---|---|---|
| 2,996,718 | 8/1961 | Foley | 343/827 X |
| 3,102,268 | 8/1963 | Foley | 343/897 X |
| 3,201,693 | 8/1965 | Vacek et al. | 343/725 X |
| 3,790,948 | 2/1974 | Ratkovich | 342/386 |
| 4,029,319 | 6/1977 | Christen | 273/422 |
| 4,621,817 | 11/1986 | Mosacchia | 273/416 X |
| 4,675,683 | 6/1987 | Robinson et al. | 342/386 |
| 4,704,612 | 11/1987 | Boy et al. | 342/386 |
| 4,749,198 | 6/1988 | Brailen | 273/416 |
| 4,850,031 | 7/1989 | Allsop et al. | 343/725 X |

FOREIGN PATENT DOCUMENTS

| | | | |
|---|---|---|---|
| 595830 | 7/1925 | France | 343/897 |

*Primary Examiner*—Paul E. Shapiro
*Attorney, Agent, or Firm*—Sidney W. Millard

[57] ABSTRACT

An arrow incorporating a radio signal transmitting device allows a hunter to find a lost arrow. The arrow includes a hollow aluminum shaft which acts as the primary transmitting antenna. A braded metal cable inside the hollow shaft acts as a secondary antenna when the primary antenna is broken, for whatever reason.

6 Claims, 3 Drawing Sheets

TRANSMITTER IN ARROW

REFERENCE TO OTHER APPLICATIONS

This application is a continuation-in-part of application Ser. No. 822,779, filed June 9, 1986, now abandoned.

FIELD OF THE INVENTION

This invention relates to a hunting arrow having incorporated therein a radio signal transmitting device which allows one to locate the arrow after it is lost from sight.

BACKGROUND OF THE INVENTION

The sport of hunting game with bow and arrow has become quite popular in recent years and one of the biggest problems is locating game which has been wounded by an arrow. Often the wounded animal still has the strength to run and hide. This is particularly true of deer. Often a deer will run for long distances and then hide from the pursuing hunter. Late in the afternoon, at dusk, the hunter can often walk within a few feet of a wounded deer without actually seeing the animal.

Another secondary problem is that an arrow which misses its target may travel several yards beyond the target and be lost to the hunter.

A solution to this problem is suggested in U.S. Pat. No. 3,790,948 which provides for a battery-powered radio transmitter placed in the head of an arrowhead. The transmitter is activated by a switch before the arrow is launched. The antenna for the transmitter is a relatively rigid metal rod which projects inside the hollow arrow shaft of wood or fiberglass. Thereby, when the arrow is dispatched it sends a continual radio signal until it is retrieved and the switch de-activates the battery-powered electrical system. The hunter carries with him a directional receiver which allows him to locate the arrow whether it be lodged in a game animal or has fallen elsewhere in the forest.

Often wounded game will dislodge the arrow or break the arrow shaft when running through the forest after it has been wounded. The transmission system of the patent is intended to continue to transmit so long as the antenna is not broken away. That could be a problem because of the rigid construction of the antenna of the patent.

Many arrows used today are not fiberglass and not hollowed out wood. Many of them are aluminum tubing and as a consequence of having aluminum tubing, the invention of the patent would not work because the transmission from the antenna described would tend to bounce off the inside walls of the aluminum shaft and would likely not be received by the receiving antenna.

SUMMARY OF THE INVENTION

To solve the problem of damage to the transmission apparatus of the arrow, this invention has moved the transmitter and battery from the arrowhead to the shaft and has made the transmitter a solid state integrated circuit device as opposed to the crystal device described in the patent. The integrated circuit transmitter is formed in a cylindrical-shape and size to fit conveniently within the hollow aluminum arrow shaft. It is also mechanically balanced so that it will not interfere with the ballistic characteristics of the arrow as it rotates about its longitudinal axis in its flight to the target.

To allow use of aluminum shafts the connection between the transmitter antenna and the shaft has been made electrically conducting, thereby, the shaft becomes the primary antenna for the transmitter. A secondary antenna is provided in the form of a braided metallic strand which extends inside the hollow aluminum shaft. Thereby, if the shaft becomes broken the secondary antenna will continue to transmit the signal until it is found. Additionally, the braided metallic strand is more flexible than the rigid rod of the patent, thereby, it is less likely to be damaged and incapacitated by breakage of the shaft itself.

Objects of the invention not clear from the above will be understood fully upon a review of the drawings and the description of the preferred embodiments which follow.

DESCRIPTION OF THE PREFERRED EMBODIMENTS

Figure 1:
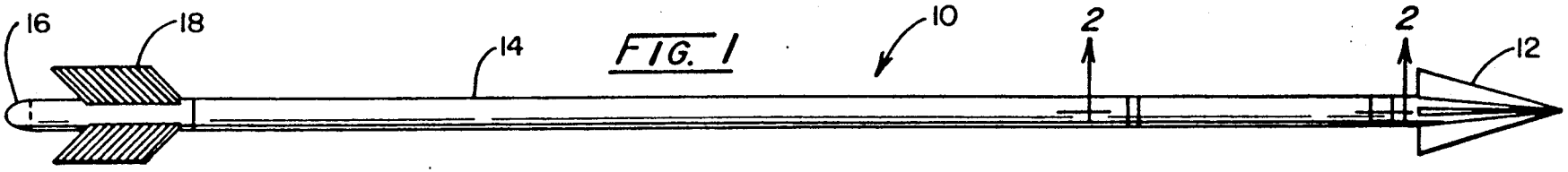
FIG. 1 is an elevational view of an arrow according to this invention.

Looking to FIG. 1, an arrow 10 incorporating a radio transmission apparatus includes a metal arrowhead 12 on the front of an aluminum shaft 14 and a nock 16 on the rear. A trio of fletchings 18 are symmetrically fastened about the shaft adjacent its rear end as is conventional with hunting arrows.

Shaft 14 is a hollow tube and on its forward end is an insert 20 which is a conventional RPS insert except that the innermost end has been drilled out at 21 to provide a passage 22 extending from one end of the insert to the other, for reasons which will be explained subsequently. The insert 20 has a smaller portion 23 extending into the hollow shaft and a shoulder 24 which abuts the end of the hollow shaft. Shoulder 24 has approximately the same cylindrical shape and outer diameter as the external surface of shaft 14. The reduced cross-sectional area 23 of the insert 20 extending into the hollow shaft may be of smaller cross-sectional area than the internal surface of the shaft and to hold the insert in position an adhesive is applied between the surfaces of the shaft and the insert. For purposes which will be explained subsequently the adhesive used is electrically conducting.

A metallic housing 26 holds a transmitter 28 and one end of the housing has an externally threaded male member 32 which is threaded into the internal threads 34 in the insert 20. The opposite end of the housing 26 is internally threaded at 36 to receive external threads 38 of ferrule 39 to thereby clamp a battery 40 into operative position to be pressed into electrical contact with the transmitter.

While different kinds of batteries could be used, in this particular embodiment it is preferred to use a conventional hearing aid or watch battery.

Threads 36 and 38 are particularly located in the combination to allow the easy replacement of the battery 40 when its useful life has been exhausted. Normally such batteries have a useful life of about sixteen hours of continuous duty. In this instance the battery is not always engaged with the transmitter so there will not necessarily be numerous battery changes but because the threads 36 and 38 are so located that they can be unthreaded and the battery replaced and then the parts be reconnected without any great difficulty.

Located within a passage 42 through ferrule 39 is a push rod 44 having an attached leaf-spring 46 at the end adjacent the battery 40.

Arrowhead 12 has external threads 48 on an extension 49 which thread into the internal threads 50 of the ferrule. Thereby extension 49 depresses push rod 44 to cause the leaf-spring 46 to urge the battery 40 into electrical contact with the transmitter 28. The threaded male end 49 of the arrowhead and/or the threads of the ferrule 39 has a corrosion preventing coating which is electrically insulating and therefore the arrowhead serves as the ground plate for the antenna. In order to insure good electric contact with the push rod 44, an abrasive may be used to remove any insulative coating from the innermost end of the arrowhead. Additional coating may be added to the threads if there is no insulative coating or if it is insufficient. Other means will also be apparent to those skilled in the electronic art to keep the arrowhead electrically insulated from the shaft-antenna so it provides the ground plate. For example, the ferrule 39 may be a synthetic resin insulator such as nylon. Unless the arrowhead is threaded into operative position, the leaf-spring will not urge the battery into electrical contact with the transmitter and thus there is no battery drain. It is within the concept of this invention to have other means for switching the transmitter on or off.

Figure 3:
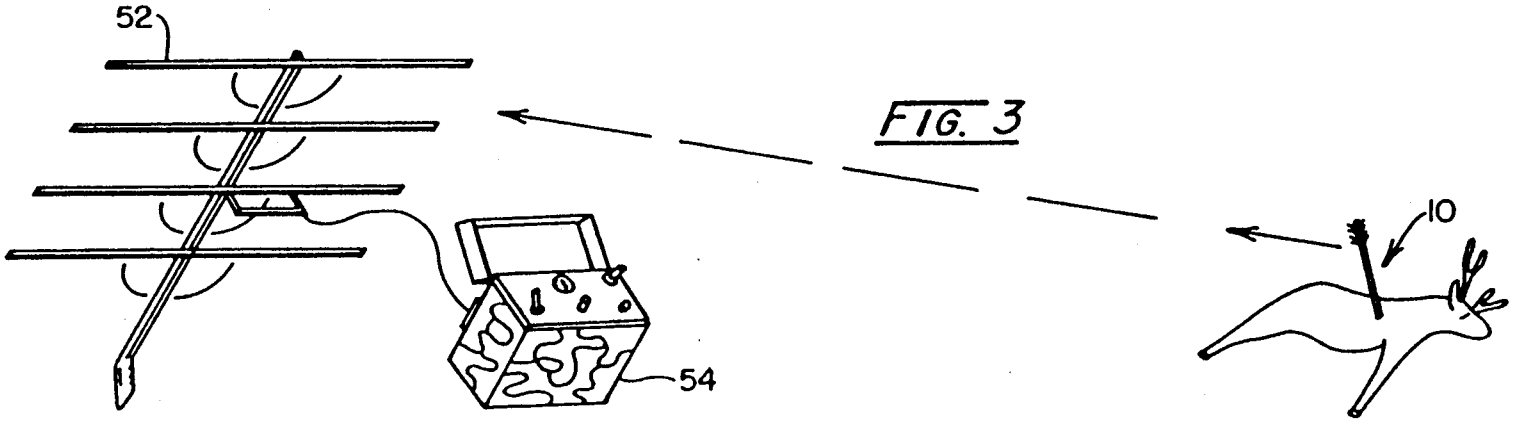
FIG. 3 is a schematic view showing a receiving antenna hooked to a receiver for receiving signals transmitted from an arrow in some remote place.

At such time as the battery and transmitter are engaged, the metallic housing 26, metallic insert 20, shaft 14 and electrically conducting adhesive bonding the insert to the shaft, all in combination serve to make the hollow aluminum shaft 14 a primary antenna to transmit radio signals. Such signals may be received by a receiving antenna 52 which is operatively connected with a conventional receiver 54, best seen in FIG. 3.

Figure 9:
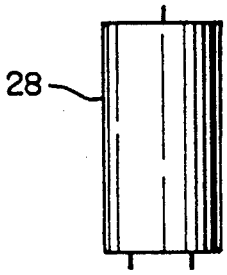
FIG. 9 is a side elevational view of the shape of the transmitter.
Figure 10:
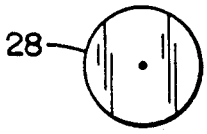
FIG. 10 is a top plan view of the shape of the transmitter of FIG. 9.

FIGS. 9 and 10 show the physical shape of the transmitter of the preferred embodiment and it is specifically a cylindrically-shaped solid state device about one-eighth inch in diameter and the total transmitter and battery length in combination is about three inches at most. The preferred cylindrical solid state transmitter 28 is preferably about one inch in length. It is contemplated that the transmitter could be attached to a rifle bullet and is designed to withstand high impacts.

Figure 2:
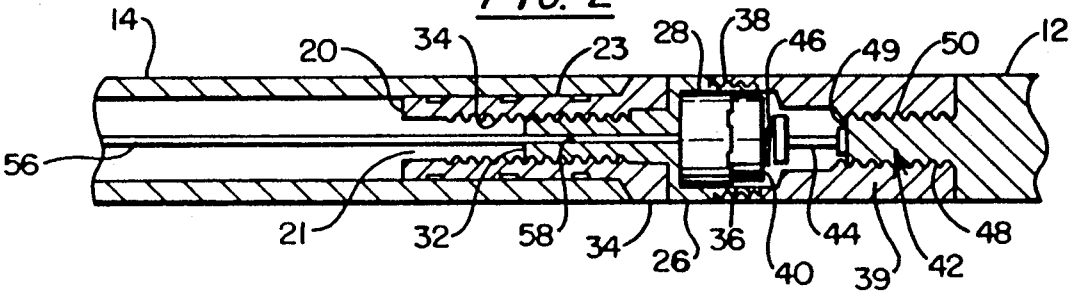
FIG. 2 is a fragmentary sectional view of the arrow of FIG. 1 taken along line 2—2.
Figure 4:
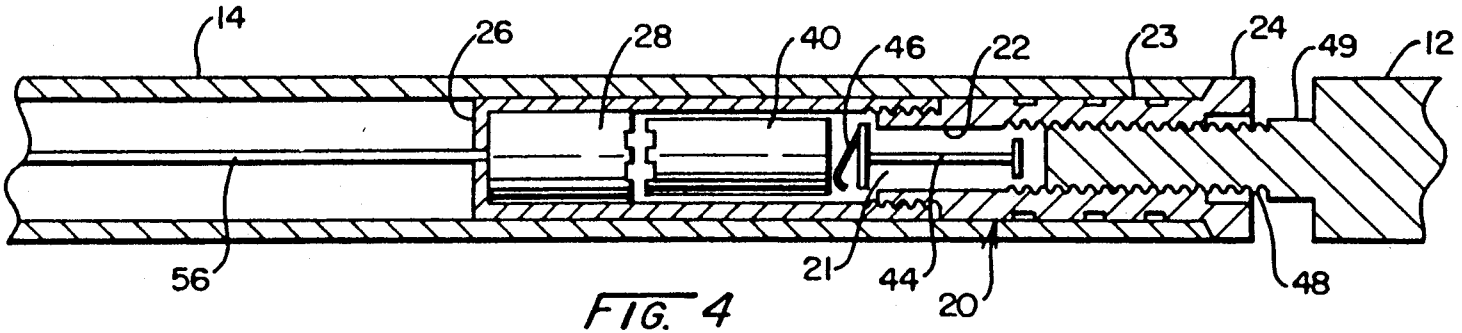
FIG. 4 is a sectional view of a second embodiment of the transmitting device similar to FIG. 2.

FIG. 4 is a second embodiment of the transmitting apparatus of this invention inside the shaft between the insert 20 and the nock 16. The only difference between FIGS. 2 and 4 is the illustrated geometric shape of the intermediate units, their function does not change.

During normal use of the arrow the arrowhead may strike a running target. Occasionally the shaft 14 becomes broken during the chase. Thereby, the transmission is greatly reduced by the shortened primary antenna. As a consequence of this problem a secondary transmitter antenna 56 is connected to the transmitter 28 through an opening 58 on the threaded male member 32 of the housing and projects on through the insert 20 into the hollow shaft 14 for a length of about eleven to seventeen inches. Because the secondary antenna 56 is normally inside the metallic shaft 14 its signal will not be received by the receiving antenna 52 because of the shielding of the aluminum shaft. However, when the aluminum shaft is broken the secondary antenna will become a supplemental transmitting antenna.

As will be clear, if the relatively rigid shaft 14 is sufficiently impacted to become broken then the same impact would break a rigid secondary antenna and both would break. To prevent this from occurring the secondary antenna 56 is a braided wire cable which is flexible. Thereby when the impact breaks the shaft 14 it will only bend the secondary antenna (which will continue to transmit). This allows the hunter to locate the injured game or locate the transmitting device should it have been dislodged from the game.

Figure 5:
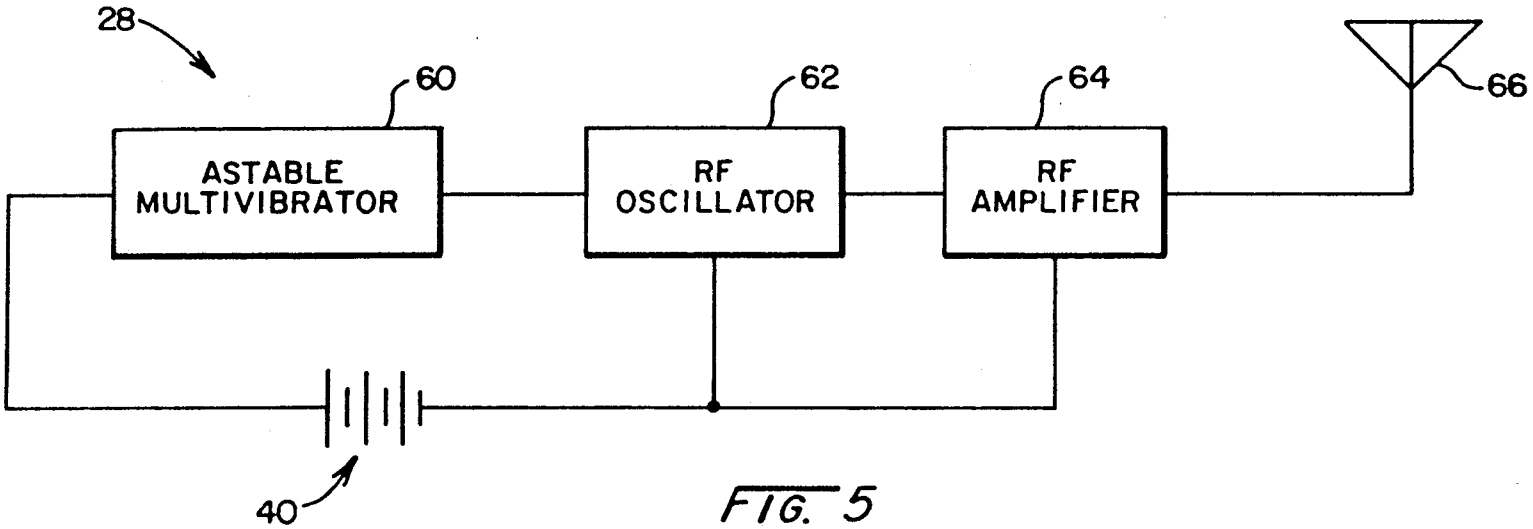
FIG. 5 is a diagram of the electrical circuit of this invention.

FIG. 5 is a schematic diagram of the electronic circuit of what has previously been referred to as the transmitter 28 including its antenna, although the unique features of the invention are not a part of the electronic circuitry itself. The simplified block diagram of FIG. 5 shows that the circuitry is powered by a battery 40 connected to an astable multivibrator 60 and also providing power to the RF oscillator 62 and the optional RF amplifier 64. The astable multivibrator 60 provides an output square wave having a period of, for example, three seconds. It is connected to periodically actuate the RF oscillator 62 to generate a series of bursts of RF energy at a suitable radio frequency. In the preferred embodiment, the RF bursts are of a duration of 1.5 seconds. In order to increase the output RF power to the antenna 66, an optional RF amplifier 64 may be used if the power from the RF oscillator 62 is insufficient for clear reception at a desired distance.

Figure 6:
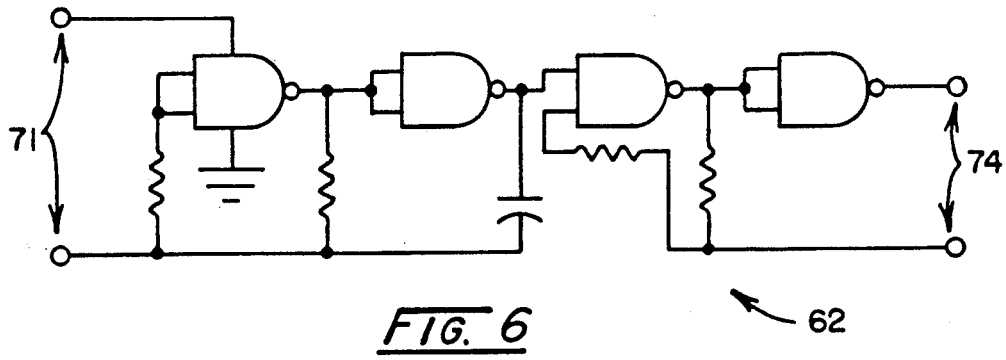
FIG. 6 is a circuit diagram of the astable multi-vibrator.
Figure 7:
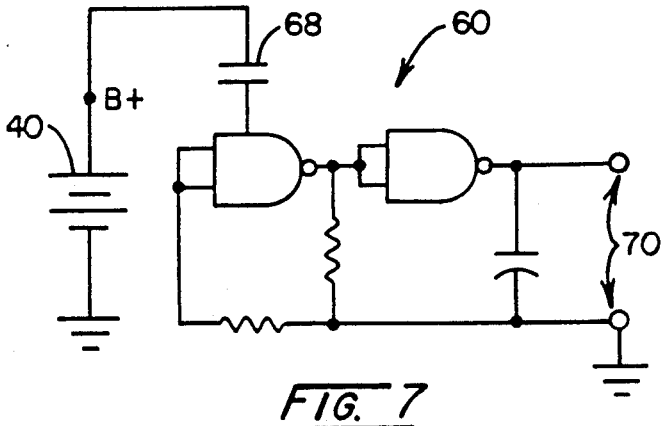
FIG. 7 is circuit diagram of the radio frequency oscillator.
Figure 8:
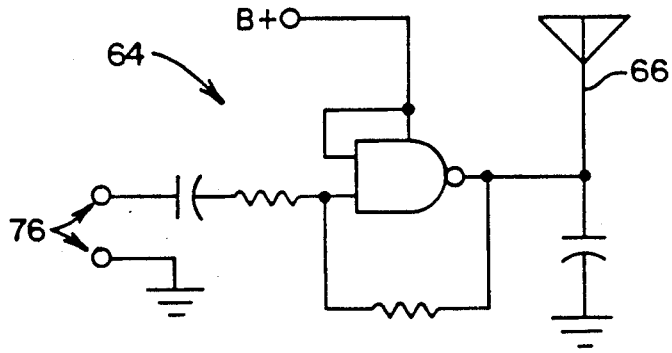
FIG. 8 is a circuit diagram of the optional radio frequency amplifier.

FIGS. 6, 7 and 8 illustrate these circuits in more detail, said circuits being constructed of conventionally available 4011 Nand gates. The switch 68 which is shown for connecting the battery 40 to the circuit is mechanically the switch which comprises the push rod 44 described previously. The multivibrator output 70 is connected to the input 71 of the RF oscillator 62 which is illustrated in detail in FIG. 6. The output 74 of the RF oscillator 62 may be connected directly to the antenna 66 if it supplies sufficient power for the homing range which is desired. Alternatively however, the output 74 of the RF oscillator 62 may be connected to the input 76 of the RF amplifier 64 which is illustrated in FIG. 8. The output of the amplifier 64 is in turn connected to the antenna 66 which is described above.

It is intended that the arrow shaft of this invention be stored in a quiver or other kind of carrying case with the fletchings 18 at the upper end and the ferrule 39 at the lower end. The arrowhead 12 will not be connected to the ferrule 39 until it is desired to shoot the arrow. Only after the arrowhead is tightened into place does it depress the push rod 44 with enough force to move the battery 40 into electrical contact with the transmitter 28. Without the arrowhead being threaded into place and with the disarmed arrow shaft in vertical position, fletchings 18 uppermost, gravity will serve to disconnect the battery from the transmitter. Thereby, when the arrow is disarmed the battery is not being discharged and its useful life is not diminished.

In the preferred embodiment the braided cable comprising the secondary antenna is covered with a non-conducting sheath of material but it has no function except to protect the secondary antenna from impacts and abrasion. It will prevent electrical contact between the primary and secondary antennas but that has no functional implications.

Having thus described the invention in its preferred embodiment, it will be clear that certain modifications may be made to the structure without departing from the spirit of the invention. For example, the frequency of transmission may be adjustable to comply with FCC regulations in a manner similar to garage door openers. It is not intended that the words used to describe the invention in the specification nor the illustrations of the drawings be limiting on the invention. Rather it is intended that the invention be limited only by the scope of the appended claims.

It should be noted that this inventive concept may be used in underwater activities and the receiving antenna could be designed for use in tracking aquatic life. The receiving system may include earphones and a meter to gauge the direction and magnitude of signals received.

I claim:

1. In the combination of an arrow, a transmitter and means forming an antenna for transmitting a signal from the transmitter, the improvement including:

(a) the arrow including an arrowhead connected to one end of a hollow aluminum shaft and fletchings at the other end of said shaft, (b) the antenna means comprising a primary antenna and a secondary antenna, (1) said primary antenna comprising the aluminum shaft and (2) said secondary antenna connected to the transmitter and extending from near the arrowhead into the hollow shaft, (c) the transmitter being located in means forming an electrically, conducting housing, said housing being electrically connected to the shaft, (d) said arrowhead being threaded into one end of an internally threaded connection means, said internally threaded connection means being threadedly connected to said transmitter housing means, (e) a longitudinally reciprocable push rod in said internally threaded connection means, said push rod being configured to move longitudinally to push a battery into electrical contact with the transmitter in response to an arrowhead being threaded into the internally threaded connection means, (f) the secondary antenna being connected to the transmitter through said housing, and (g) the primary antenna, being connected to the transmitter by the housing being threaded to said connection means on the end of the hollow shaft, said connection means being in electrical contact with the shaft.

2. The combination of claim 1 wherein said connection means is an insert connected to the shaft by electrically conducting adhesive.

3. The combination of claim 2 wherein the insert fits into the end of the hollow shaft, said insert being internally threaded to receive an externally threaded male member projecting from the housing.

4. The combination of claim 3 wherein the secondary antenna is a flexible braided metal cable.

5. The combination of claim 2 wherein the secondary antenna is a flexible braided metal cable.

6. The combination of claim 1 wherein the secondary antenna is a flexible braided metal cable.

* * * * *